US007532190B2

(12) United States Patent
Lin et al.

(10) Patent No.: US 7,532,190 B2
(45) Date of Patent: May 12, 2009

(54) MULTI-RESOLUTION DRIVER DEVICE

(75) Inventors: Hsiao-Yi Lin, Hsinchu (TW); Wei Wang, Hualien (TW); Chaung-Ming Chiu, Jungli (TW); Yu-Yun Hsu, Hsinchu (TW)

(73) Assignee: TPO Displays Corp., Chu-Nan (TW)

( * ) Notice: Subject to any disclaimer, the term of this patent is extended or adjusted under 35 U.S.C. 154(b) by 551 days.

(21) Appl. No.: 10/916,361

(22) Filed: Aug. 10, 2004

(65) Prior Publication Data

US 2005/0068287 A1 Mar. 31, 2005

(30) Foreign Application Priority Data

Aug. 12, 2003 (TW) ..... 92122064 A

(51) Int. Cl.
*G09G 3/36* (2006.01)

(52) U.S. Cl. ..... 345/100; 345/98

(58) Field of Classification Search ..... 345/61, 345/63, 77, 98, 100, 197, 690, 698, 699, 345/99, 101, 102
See application file for complete search history.

(56) References Cited

U.S. PATENT DOCUMENTS 5,448,259 A * 9/1995 Hidaka ..... 345/99
6,191,770 B1 * 2/2001 Kim ..... 345/100
6,392,642 B1 * 5/2002 Wu ..... 345/213
2001/0005194 A1 * 6/2001 Hiroki ..... 345/99
2002/0063710 A1 * 5/2002 Hirota et al. ..... 345/428
2003/0169247 A1 * 9/2003 Kawabe et al. ..... 345/204

* cited by examiner

*Primary Examiner*—Chanh Nguyen
*Assistant Examiner*—Pegeman Karimi
(74) *Attorney, Agent, or Firm*—Liu & Liu

(57) ABSTRACT

A driver device for providing multi-resolution modes for a display device, a liquid crystal display panel for example, is provided in this invention. This display driver includes a pixel circuit and a gate driving circuit. The gate driving circuit is coupled to the pixel circuit via a plurality of gate lines and determines either an original gate driving signal or a target gate driving signal to be the gate drive signal in response to the gate control signal. Wherein a switch circuit is configured for switching between the original driving signal and the target gate driving signal via a plurality of switches corresponding to shift registers therein. A source driving circuit is further incorporated in this present invention to configure a multi-resolution display device, coupled to the pixel circuit via a plurality of source lines and outputs the source driving signal in response to a source control signal.

14 Claims, 7 Drawing Sheets

MULTI-RESOLUTION DRIVER DEVICE

CROSS-REFERENCE TO RELATED APPLICATION

This application claims the priority benefit of Taiwan application serial no. 92122064, filed on Aug. 12, 2003.

BACKGROUND OF THE INVENTION

1. Field of the Invention

This invention generally relates to a driver device providing multiple resolution modes for a display device, and more particularly to a multi-resolution driver device for a liquid crystal display panel.

2. Description of Related Art

A still picture comprises of a plurality of small dots representing different shades with density variation of dots. During printing picture process, silver nitrate is used to display the shades of each dot. Hence, when a picture is photoengraved, it is distinct that the printed picture consists of a plurality of small dots. Those small dots are so-call pixels. Re-transmitting and rearranging a plurality of pixels, the original image is reproduced accordingly. The quality of the picture is represented by the image resolution, or definition, which relies on a number of pixels. The number of the pixels is usually calculated by dots per inch. The more pixels in a frame, the better quality of the picture. Hence, when a picture having a particular size consists of more pixels, the image resolution is higher and the reproduced image provides more detailed information.

Since flat panel displays, e.g., liquid crystal display (LCD) and plasma display, provide better resolution and lower power consumption than the traditional Cathode Ray Tube (CRT) display, they become substitutes for the CRT display nowadays. While LCDs always serve as displays for laptop/notebook computers, they serve as displays for desktop computers as well; even the LCD panels are highly priced. Current LCD panel adopts active matrix design such as Thin Film Transistor (TFT) technology, which is one-to-one design; i.e., one thin film transistor corresponds to one pixel. The advantage of the active matrix design is that it only requires a small current flow for the horizontal and vertical grids, so that the pixels can be turned on/off relatively quickly. The TFT LCD comprises an optically anisotropic liquid crystal layer, which transmit the amount of the incoming light based on the strength of the electrical field, thereby acquiring corresponding pixels to the image information.

An LCD also includes an interface circuit transforming analog signals from a host system to digital signals in order to drive the pixels in the LCD. Because the resolution of the LCD depends on the number of the pixels in the active display area, the LCD has to be operated under defined display mode. For instance, in order to display a Video Graphic Array (VGA) image, the active display area has to configure 640*480 pixels. In order to display a Quarter Video Graphic Array (QVGA) image, the active display area has to configure a quarter pixels of the VGA mode, i.e. 320*240 pixels. In order to display a super video graphic array (SVGA) image, the active display area has to configure 800*600 pixels; and in order to display an extended Graphic Array (XGA) image, the active display area has to be configured 1024*768 pixels. Hence, it is desirable to configure a LCD display with multiple resolution modes to accommodate a variety of available resolutions, where frequently used QVGA and VGA modes are particularly desirable.

SUMMARY OF THE INVENTION

The present invention is directed to a novel driver device for display devices, which drives the display pixels according to the resolution of the input image data. Depending on the input image data resolution, the physical pixels may be driven individually in sequence, or two or more physical pixels may be grouped as a logical pixel (i.e., driven simultaneously) and adjacent logical pixels are driven in sequence.

In one aspect, this invention is to provide a multi-resolution display driver for a display device, wherein a liquid crystal display is exemplary yet not exclusive, which comprises a pixel circuit, a gate driving circuit, and a source driving circuit. Wherein the pixel circuit generates an image according to a gate driving signal and a source driving signal. The gate driving circuit couples to the pixel circuit via a plurality of gate lines, for determining to propagate gate driving signal to gate lines as original gate driving signal or target gate driving signal according to gate control signal. Wherein the original gate driving signal and the target gate driving signal are controlled by a switch circuit; and a source driving circuit couples to the pixel circuit via a plurality of source lines for outputting the source driving signal in response to a source control signal.

The present invention is to provide a multi-resolution driver device for a display device, wherein a liquid crystal display panel is exemplary yet not exclusive. This driver device outputs a target driving signal after a switch circuit performs in response to a gate control signal to alter the original resolution to the target resolution and to display the image with the target resolution. The target resolution is either full resolution or sub-resolution, i.e. half or quarter or other fractions of the original full resolution. Further, because the apparatus configures within the LCD panel, the present invention does not require an additional space to accommodate this apparatus for the devices are small in size, thus it is cost-effective and power efficient.

DESCRIPTION OF THE PREFERRED EMBODIMENTS

Figure 1:
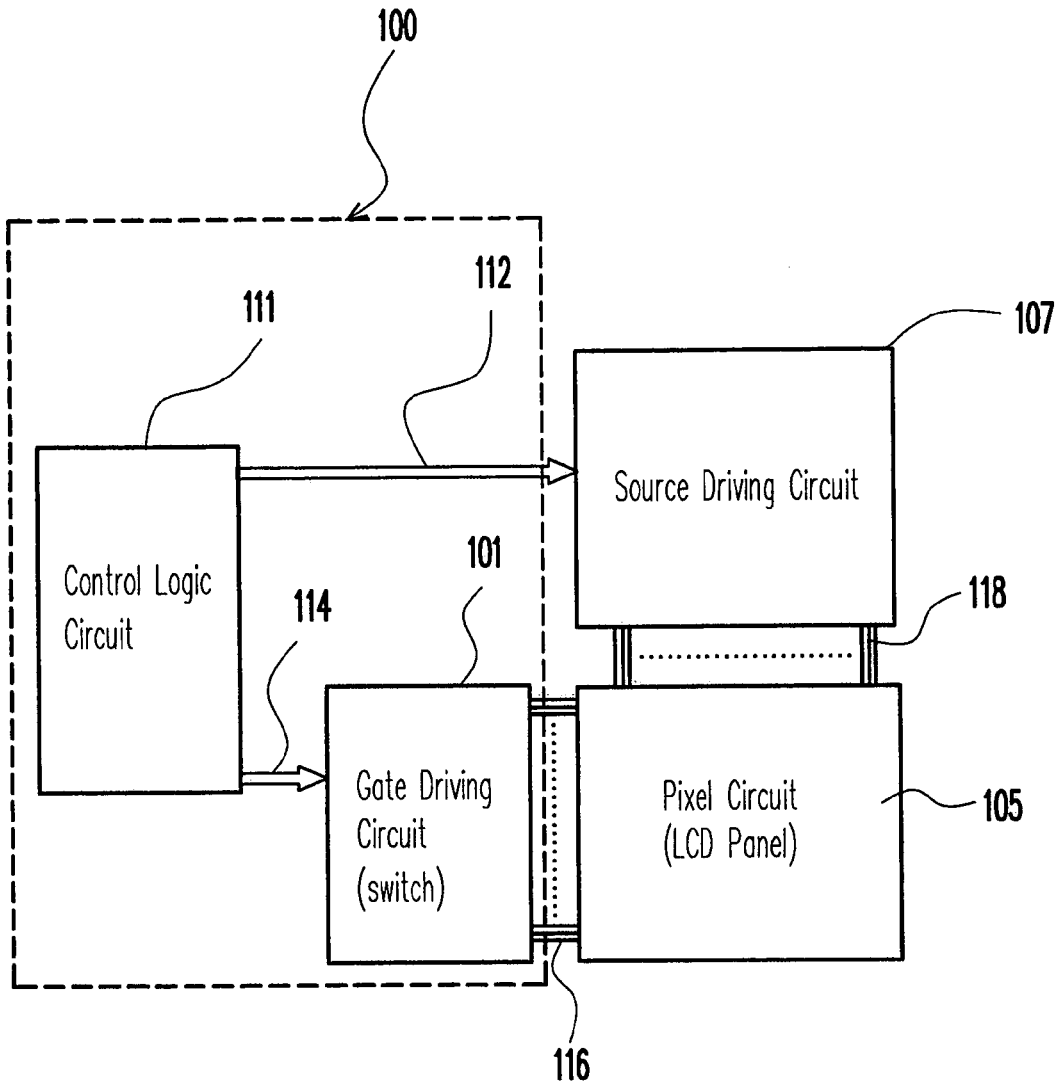
FIG. 1 is a block diagram illustrating an apparatus for altering resolution of a LCD panel in accordance with a preferred embodiment of the present invention.

Referring to FIG. 1, it is a block diagram of an apparatus 100 for providing multiple resolution modes of a LCD panel in accordance with a preferred embodiment of the present invention. This apparatus 100 includes a gate driving circuit 101, and a control logic circuit 111. The apparatus 100 is operatively coupled to a source driving circuit 107 and a pixel circuit 105. The pixel circuit 105 generates an image in response to a gate driving signal and a source driving signal, which are carried by the gate line 116 and the source line 118, respectively. The gate driving circuit 101 is coupled to the pixel circuit 105 via a plurality of gate lines 116. The control logic circuit 111 determines the resolution of the image to be rendered by the pixel circuit 105 from the input image data. For example, the control logic circuit determines one of an original gate driving signal and a target gate driving signal as the gate driving signal in response to the signal carried by the gate control line 114. The source driving circuit 107 is coupled to the pixel circuit 105 via a plurality of source lines 118 and outputs the source driving signal in response to a source control signal carried by the source control line 112. The control logic circuit 111 provides the gate control signal and the source control signal carried by the gate control line 114 and the source control line 112, respectively. Although the control logic circuit 111 and source driver circuit 107 taken alone are not within the scope of the present invention, one skilled in the art could understand this circuit and can apply an ASIC (Application Specific Integrated Circuit), for example, to implement this circuit to operate in conjunction with the gate driving circuit 101 described herein.

Figure 2A:
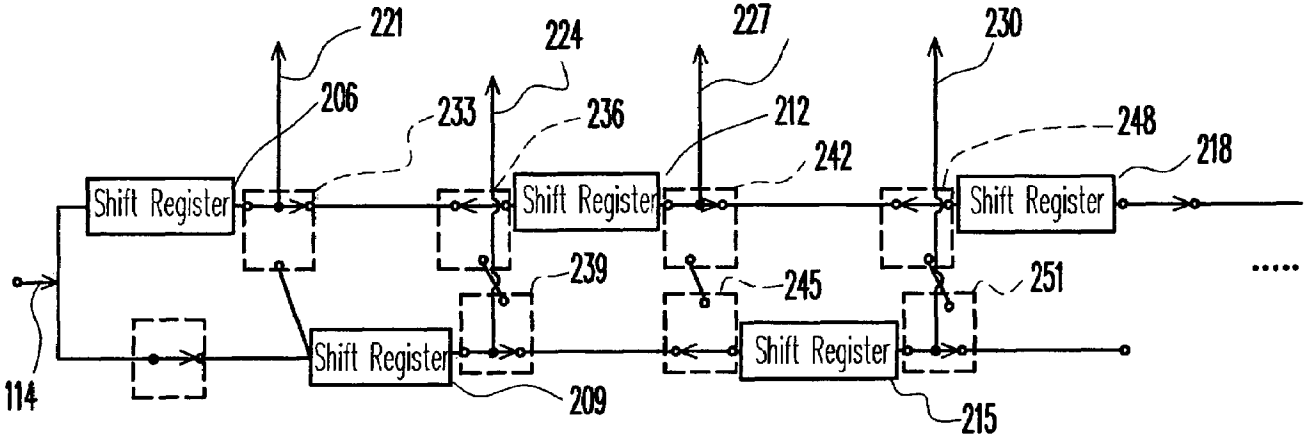
FIG. 2A is a circuit diagram illustrating a gate driving circuit for displaying with original resolution in accordance with the first preferred embodiment of the present invention.
Figure 2B:
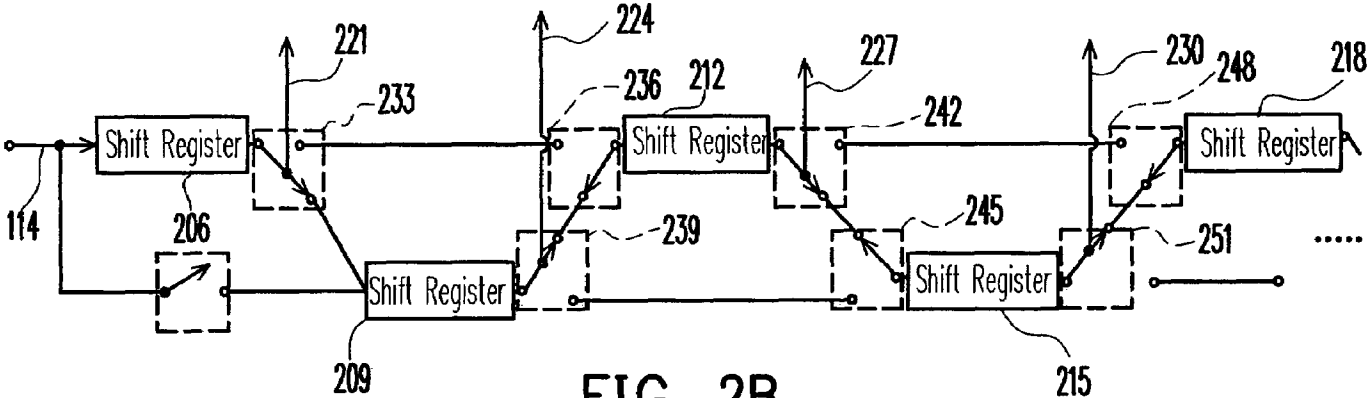
FIG. 2B is a circuit diagram illustrating a gate driving circuit for displaying with target resolution in accordance with the first preferred embodiment of the present invention.

The gate driving circuit 101 uses a switch circuit to switch between outputting the original gate driving signal and the target gate driving signal. Each gate line corresponds to a different pixel. However, when two gate lines transmit the same gate driving signal, the two physical pixels corresponding to those two gate lines are deemed to be a single logical pixel. Hence, when each pair of gate lines transmits the same gate driving signal, the resolution of the LCD panel becomes one half of the original resolution, in one orthogonal direction of the panel. Referring to FIGS. 2A and 2B, FIG. 2A is a gate driving circuit providing the original resolution in accordance with the first embodiment of the present invention; FIG. 2B is a gate driving circuit under the target resolution in accordance with the first embodiment of the present invention. The first embodiment includes a plurality of shift registers 206-218, a plurality of gate lines 221-230, and a plurality of register switches 233-251. The shift registers 206-218 output the gate driving signals via the plurality of gate lines 221-230. The register switches 233-251 to switch between the operating modes shown in FIG. 2A and FIG. 2B in response to the gate control signal 114 to output either the original gate driving signal or the target gate driving signal. In FIG. 2B, the register switches 233-251 will activate the shift registers 206-218 and the shift registers being one stage behind shift registers 206-218. In FIG. 2A, the register switches 233-251 will activate the shift registers 206-218 and the shift registers being two stages behind shift registers 206-218; the gate control signal 114 is propagated to input terminals of the shift register 206 and the shift register 209 at the same time.

The register switch serves to activate an output terminal of a specific shift register and the input terminal of the shift register being one stage behind, or to activate the output terminal of a specific shift register and the input terminal of the shift register being two stages behind. For example, assume that the specific shift register is the shift register 206. The register switch 233 will determine whether to activate the shift register 206 with the shift register 209 (in a first resolution mode) or with the shift register 212 (in a second resolution mode) in response to the gate control signal 114. The other register switches are similarly operated without further discussion.

In the first preferred embodiment, when the shift register 206 activates the shift register 209, the shift register 209 activates the shift register 212 in the mode shown in FIG. 2B. The operations of the other shift registers downstream are analogous, as shown in FIG. 2B. Each gate driving signal via the gate line inputs to the LCD panel on which a target number of pixels are presumed distinguishable. On the other hand, when the shift register 206 activates the shift register 212, the shift register 209 activates the shift register 215, and the following embodiments are analogous as shown in FIG. 2A. Each gate driving signal via the gate line inputs to the LCD panel on which half of the target number of pixels is distinguishable. Assuming this half number is an original number, which is one half of the target number, the original resolution is a half of the target resolution, thus resolution mode that displayed with the pixels of the LCD panel is changed.

Figure 3A:
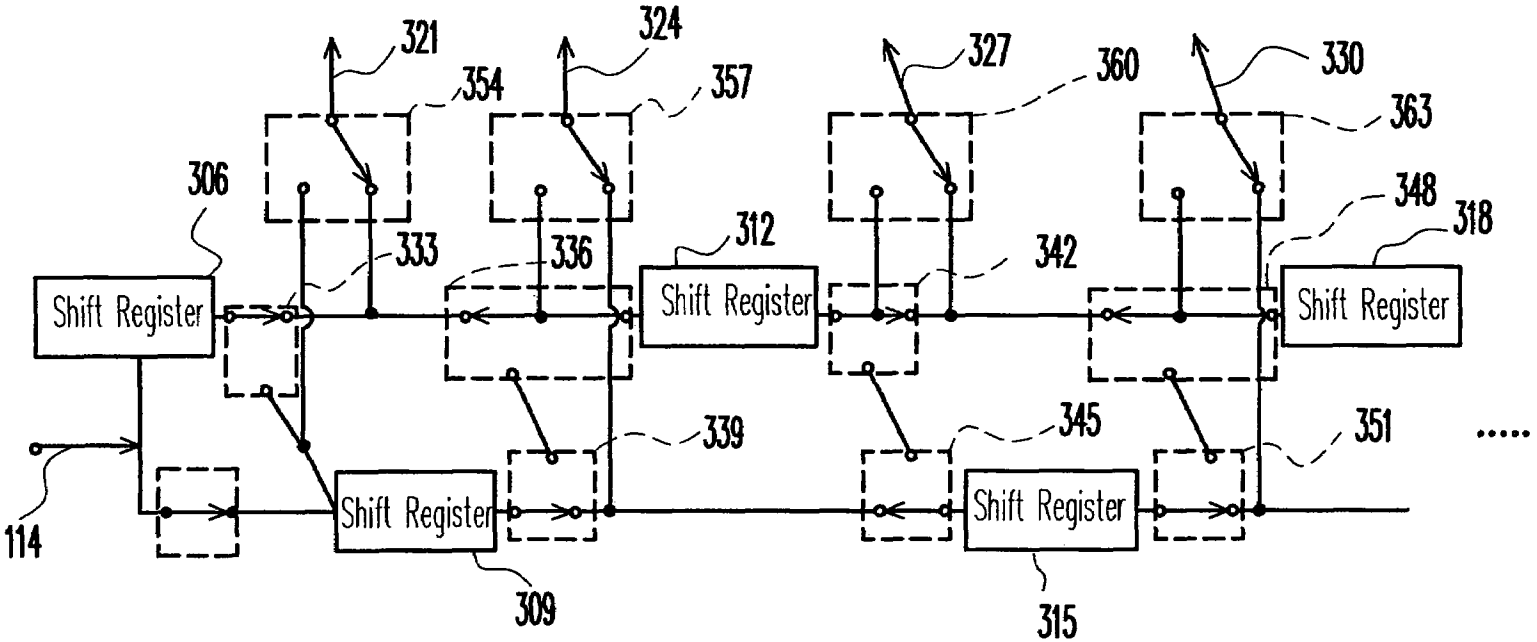
FIG. 3A is a circuit diagram illustrating a gate driving circuit for displaying with original resolution in accordance with the second preferred embodiment of the present invention.
Figure 3B:
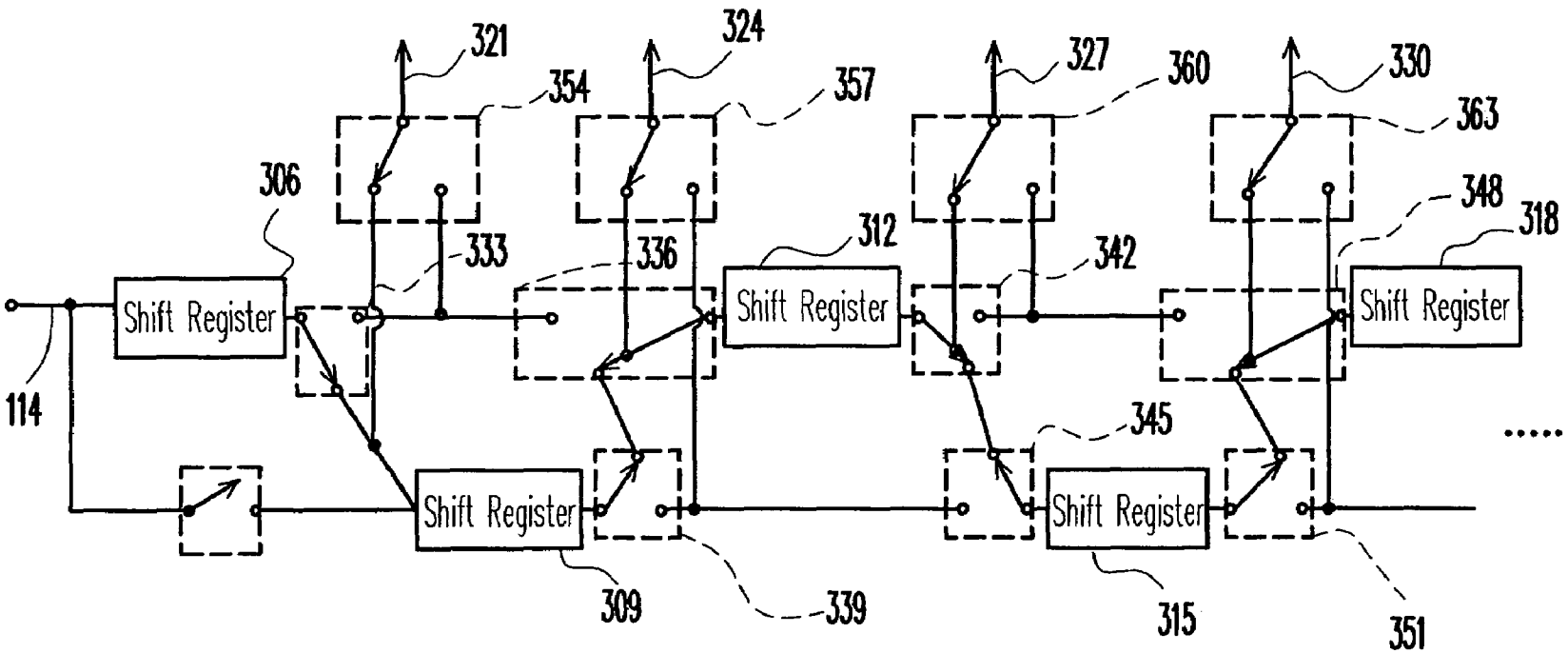
FIG. 3B is a circuit diagram illustrating a gate driving circuit for displaying with target resolution in accordance with the second preferred embodiment of the present invention.

Referring to FIGS. 3A and 3B, the gate driving circuits with original resolution and with target resolution are illustrated respectively according to the second preferred embodiment of the present invention. The gate driving circuit according to the second preferred embodiment herein includes a plurality of shift registers 306-318, a plurality of gate lines 321-330, a plurality of register switches 333-351, and a plurality of gate line switches 354-363. Gate line switches 354-363 configuring the gate lines 321-330 are added with respect to the first preferred embodiment, whose operation is described hereafter. When the register switches 333-351 are configured as illustrated in FIG. 3B, the shift register 306 activates the shift register 309, and the gate line switch 354 activates the shift register 306, the shift register 309, and the pixel circuit 103. In brief, when the shift registers 333-351 are configured as illustrated in FIG. 3B, the gate line switches trigger a shift register to activate the shift register being one stage and the pixel circuit 103. When the register switches 333-351 are configured as illustrated in FIG. 3A, the shift register 306 activates the shift register 312, and the gate line switch 354 activates the shift register 306, the shift register 312, and the pixel circuit 103 via gate line 321. In other words, when the shift registers are configured as illustrated in FIG. 3A, the gate line switches will activate the shift register to the shift register being two stages behind and the pixel circuit 103.

Figure 4A:
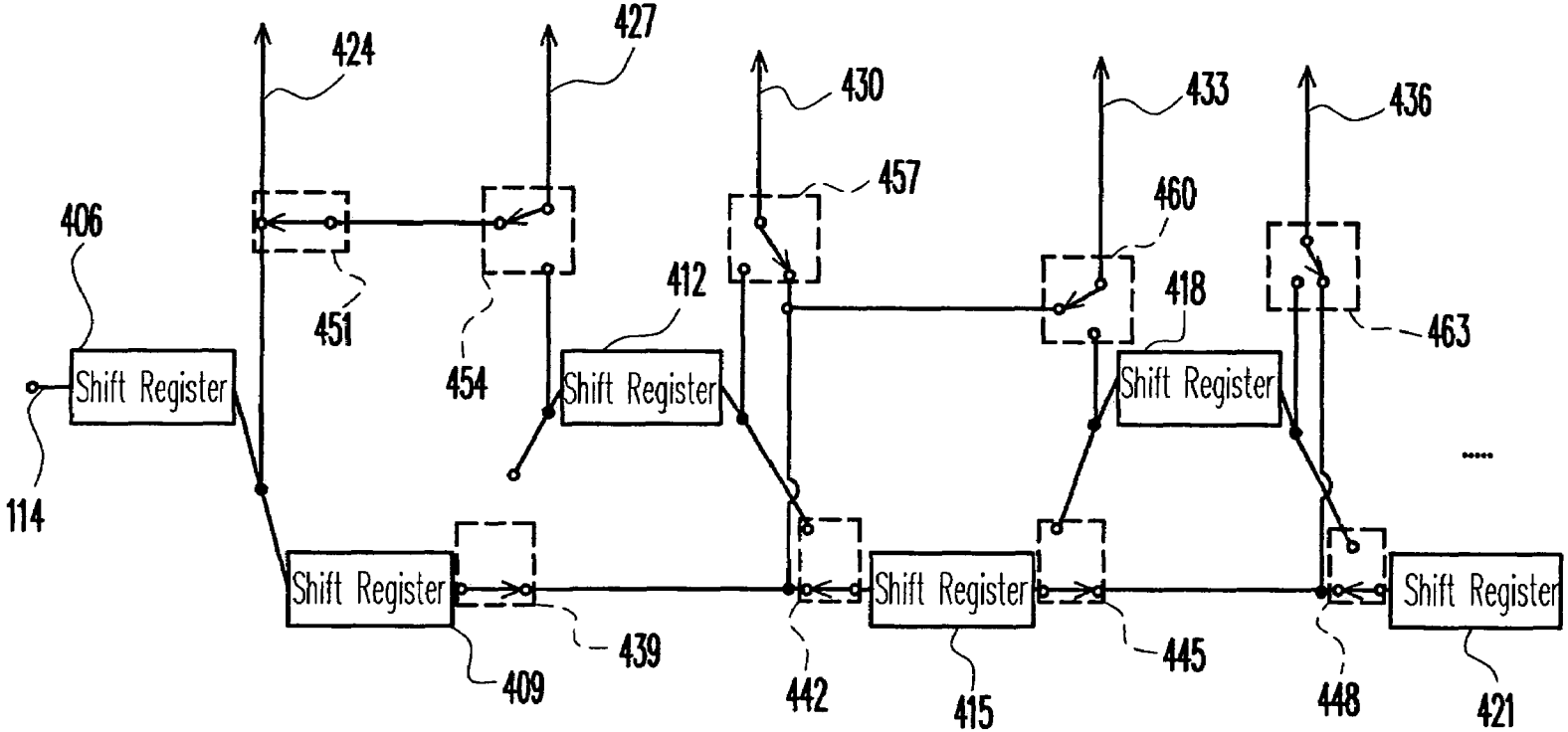
FIG. 4A is a circuit diagram illustrating a gate driving circuit for displaying with original resolution in accordance with the third preferred embodiment of the present invention.
Figure 4B:
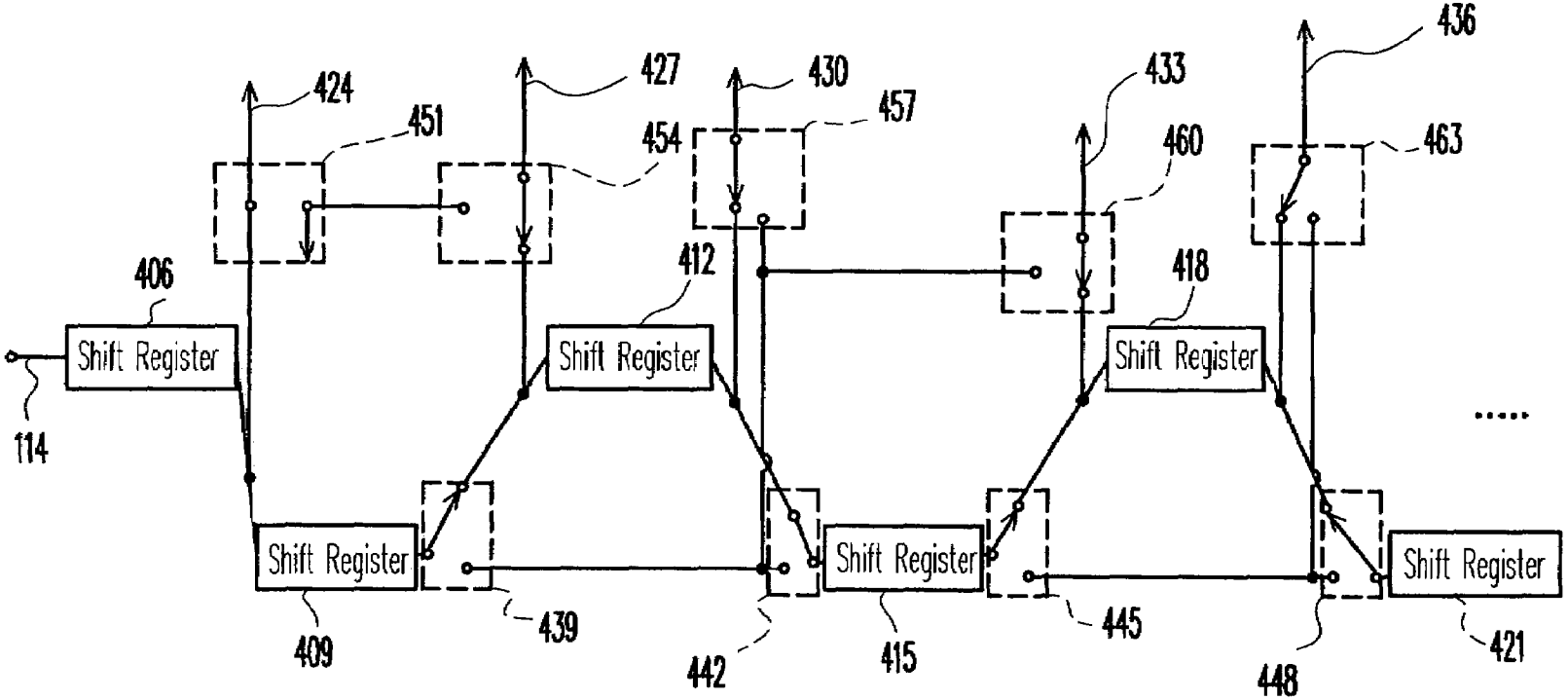
FIG. 4B is a circuit diagram illustrating a gate driving circuit for displaying with target resolution in accordance with the third preferred embodiment of the present invention.

Referring to FIGS. 4A and 4B, gate driving circuit diagrams with original and target resolution are illustrated respectively according to a third preferred embodiment of the present invention. The gate driving circuit in this preferred embodiment comprises a plurality of shift registers 406-421, a plurality of gate lines 424-436, a plurality of register switches 439-448, and a plurality of gate line switches 451-463. The third preferred embodiment possesses a different operation of the gate line switch from that of the second embodiment. When the register switches are configured as illustrated in FIG. 4B, the register switches activate the shift registers 406-421 with to the shift registers being one stage behind and the pixel circuit 103, which operates similarly as that of the second preferred embodiment. For example, when the shift register 415 activates the shift register 418, the gate line switch 460 activates the shift register 415, the shift register 418 and the pixel circuit 103. Yet when the shift registers are configured as illustrated in FIG. 4A, the gate line switch 451 couple the first and the second shift registers 406 and 409 of the shift registers 406-421 to the pixel circuit 103. Meanwhile, the gate-line switch 451 activates the shift register 409 with that being two stages behind and the pixel circuit 103. In FIG. 4A, the shift registers 412 and 418 are essentially disabled, while the shift registers 409, 415 and 421 each controls two gate lines (e.g., shift register 409 controls two 424 and 427). Hence in this embodiment, a set of shift registers switch from the control of one gate line to two gate lines, and another set of shift registers switch from the control of one gate line to a disabled state.

For example, when the shift register 415 activates the shift register 421, the gate line switch 463 activates the shift register 415, the shift register 421, and the pixel circuit 103. It should be noted that when the register switches are configured as illustrated in FIG. 4A, the gate line switches are orderly connected to the gate lines in pairs. For the skilled in the art, it is understood that according to the circuit configuration as described in the preferred embodiments herein, the odd stages of the shift registers in target resolution mode are not operative except for shift register 406, hence power consumption is reduced thereby.

Figure 5:
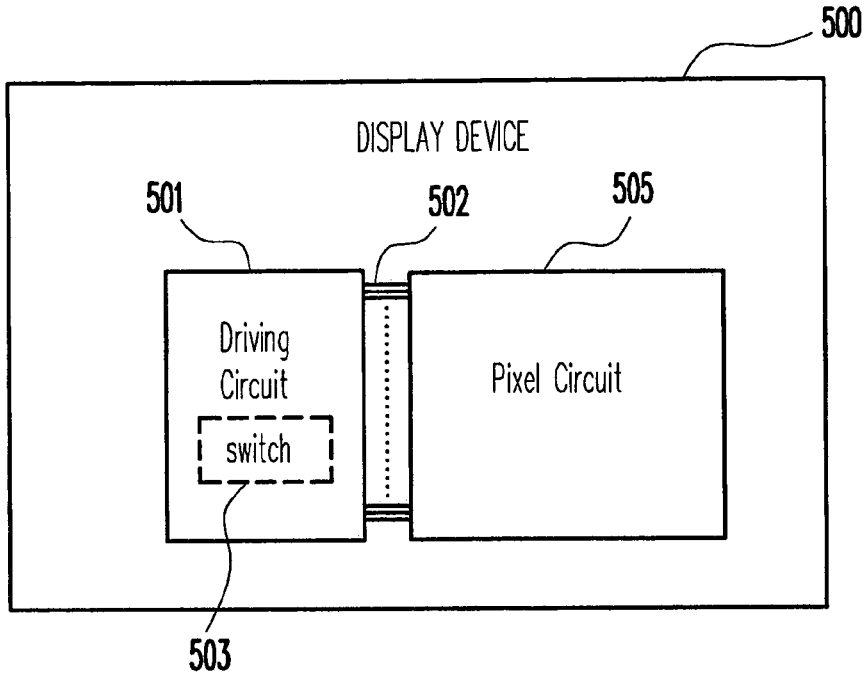
FIG. 5 is a schematic diagram illustrating an LCD device as an example of a display device incorporating the novel multi-resolution drive circuit in accordance with one preferred embodiment of the present invention.

FIG. 5 is a schematic diagram illustrating a liquid crystal display incorporating the driving circuit according to one embodiment of the present invention. In FIG. 5, a display device 500 at least includes a driving circuit 501 which includes a plurality of switches for switching between selected groups of shift registers (not shown), and therefore, one of the resolution modes available for display is selected; and a pixel circuit 505 for image output. The pixel circuit 505, taking a liquid crystal display element in this preferred embodiment of the present invention, also proper being a plasma display element, an organic-LED display element, and a liquid crystal display element, is coupled to the driving circuit via a bus interface 502. The switch circuitry 503 is similar to that of FIGS. 2A to 4B, which is switchable between at least two modes for providing one and above resolution modes for display. Therefore the switch configuration is not repeated herein this preferred embodiment.

While the inventive driving circuit is described above in connection with an LCD display system, the inventive driving circuit concept may be applied in other types of display systems for display images at different resolutions. For example, other types of display systems that may take advantage of the present invention include plasma display devices, electroluminescence display devices, organic-LED devices, etc.

Figure 6:
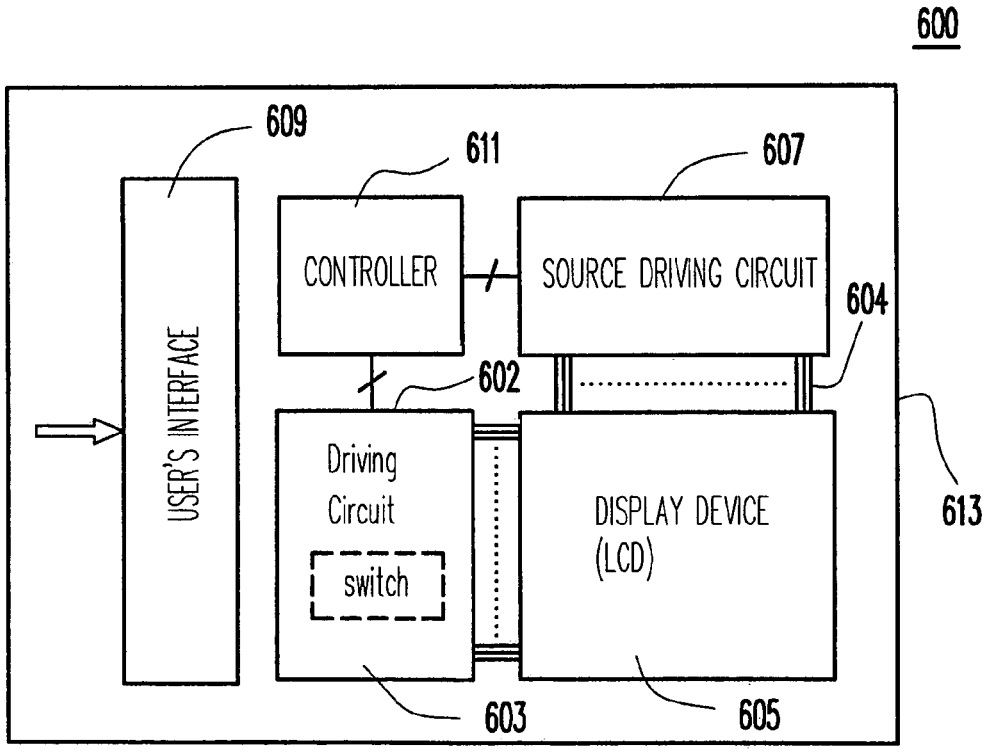
FIG. 6 is a schematic diagram showing an electronic device having a display device incorporating the novel multi-resolution drive circuit in accordance with one preferred embodiment of the present invention.

FIG. 6 schematically show an electronic device 600 incorporating the liquid crystal display 500 in FIG. 5 described above. The electronic device 600 may be a portable device such as a PDA, notebook computer, tablet computer, cellular phone, or a display monitor device, etc. Generally, the electronic device includes a housing 613, the liquid crystal display having the driving circuit 602, device controller 611, user interface 609, etc.

The above description provides a full and complete description of the preferred embodiments of the present invention. Various modifications, alternate construction, and equivalent may be made by those skilled in the art without changing the scope or spirit of the invention. For example, while the foregoing description refers to the switching between a first resolution mode and a second resolution mode that is at half the resolution of the first resolution mode, the novel driver circuit may be configured to switch between more than two resolution modes without departing from the scope and spirit of the present invention. For example, compared to the embodiment shown in FIG. 2, instead of a two-tier arrangement of shift registers, a three-tier arrangement of shift registers may be configured to provide for switching between three operating modes at three different resolutions. Accordingly, the above description and illustrations should not be construed as limiting the scope of the invention, which is defined by the following claims.

What is claimed is:

1. A driver device for a display device, for switching an original resolution to a target resolution in response to a gate control signal, comprising:

a pixel circuit, generating an image in response to a gate driving signal and a source driving signal;

a gate driving circuit, coupled to said pixel circuit via a plurality of gate lines, one of an original gate driving signal and a target gate driving signal is selected to be a. gate driving signal in response to a gate control signal, wherein said original gate driving signal and said target gate driving signal are controlled by a switch circuit; and a source driving circuit coupled to said pixel circuit via a plurality of source lines, generating said source driving signal in response to a source control signal, wherein said gate driving circuit comprises:

a plurality of shift registers, for outputting said gate driving signal; and a plurality of shift register switches, for switching between following two conditions A and B in order to choose from one of said original gate driving signal and said target gate driving signal according to said gate control signal, wherein A: said shift registers activating said shift registers being one stage behind, and B: said shift registers activating said shift registers being two stages behind, wherein when said shift register switches switch to condition B, said gate control signal is input to a first shift register and a second shift register of said shift registers at a same time with respect to the gate control signal, and when said shift register switches switch to condition A, said gate control signal is input to the first shift register and the second shift register in series with respect to the gate control signal, and wherein number of distinguishable pixels in response to the condition B is one half of number of distinguishable pixels in response to the condition A, wherein in condition A, the first shift register is switched by at least one of the plurality of the register switches to connect to the second shift register, and the gate control signal is input to the first shift register and the first shift register outputs to the second shift register, and wherein in condition B, the first shift register is switched by said at least one of the plurality of register switches to disconnect from the second shift register.

2. The driver device of a display device as recited in claim 1, wherein said Bate driving circuit further comprises:

a plurality of gate line switches, triggering said shift registers to activate said shift registers being one stage behind and said pixel circuit when said shift register switches switch to condition A, and said shift registers to activate said shift registers being two stages behind and said pixel circuit when said register switches switch to condition B.

3. The driver device of a display device as recited in claim 1, wherein said gate driving circuit further comprises:

a plurality of gate line switches, triggering said shift registers to activate said shift registers being one stage behind and said pixel circuit when said shift register switches switch to condition A, wherein a first shift register is triggered to activate a second shift register of said shift registers and said pixel circuit, and triggering said second shift register activating said shift registers being two stage behind and said pixel circuit when said shift register switches switch to condition B.

wherein when said register switches switch to condition B, said gate lines are connected in pairs.

4. A display device, comprising:

a display element; and a driving circuit having a driver device of claim 1,coupled to and driving the display element.

5. The display device as recited in claim 4, wherein the display element is at least one of a plasma display element, an organic-LED display element, and a liquid crystal display element.

6. A driver device for a display device, which supports different display resolution modes, comprising:

a pixel circuit, generating an image in response to a gate driving signal and a source driving signal;

a source driving circuit, coupled to said pixel circuit via a plurality of source lines, generating said source driving signal in response to a source control signal; and a gate driving circuit coupled to said pixel circuit via a plurality of gate lines, selectively generating gate driving signals to respective gate lines in response to a gate control signal for different display resolution modes, wherein the gate driving signals correspond to first gate driving signals corresponding to a first resolution mode and second gate driving signals corresponding to a second resolution mode; and wherein the gate diving circuit comprises:

a plurality of shift registers, including a first shift register and a second shift register, output of each being coupled to a respective gate line;

a plurality of register switches; wherein the shift registers and the register switches are operatively connected to switch between a first shift register configuration in which the first shift register and the second shift register are connected in series with respect to the gate control signal to output the first gate driving signals corresponding to the first resolution mode, and a second shift register configuration in which the first shift register and the second shift register are connected in parallel with respect to the gate control signal to output the second gate driving signals corresponding to the second resolution mode, wherein in the first shift register configuration, the first shift register is switched by at least one of the plurality of the register switches to connect to the second shift register, and the gate control signal is input to the first shift register and the first shift register outputs to the second shift register, and wherein in the second shift register configuration, the first shift register is switched by said at least one of the plurality of register switches to disconnect from the second shift register, and the gate control signal is input to the first shift register and the second shift register at a same time.

7. The drive device as in claim 6, wherein number of distinguishable pixels in the second resolution mode is one half of number of distinguishable pixels in the first resolution mode.

8. The drive device as in claim 6, wherein the gate driving circuit further comprises a plurality of gate switches operatively coupling output of each shift register to respective gate lines, wherein the gate switches maintain connections between each shift register and respective gate lines in both the first shift register configuration and the second shift register configuration.

9. The drive device as in claim 6, wherein the plurality of shift registers includes a first set of a plurality of first shift registers and a second set of a plurality of second shift registers, and wherein outputs of the first shift registers and the second shift registers are coupled to alternative gate lines.

10. The drive device as in claim 9, wherein number of distinguishable pixels in the second resolution mode is one half of number of distinguishable pixels in the first resolution mode.

11. The drive device as in claim 9, wherein in. the first resolution mode, the gaze control signal is input to a first shift register which outputs to a second shift register which outputs to another first Shift register, which outputs to another second shift register, and wherein in the second resolution mode, the gate control signal is input to a first shift register and a second shift register in parallel with respect to the gate control signal, which first shift register outputs to another first shift register, and so forth, and which second shift register outputs to another second shift register, and so forth.

12. The drive device as in claim 9, wherein the gate driving circuit further comprises a plurality of gate switches operatively coupling output of each first and second shift registers to respective gate lines, wherein the gate switches maintain connections between each first and second shift registers and respective gate lines in both the first shift register configuration and the second shift register configuration.

13. A display device, comprising:

a display element; and a driving circuit having a driver device of claim 6, coupled to and driving the display element.

14. The display device as recited in claim 13, wherein the display element is at least one of a plasma display element, an organic-LED display element, and a liquid crystal display element.

* * * * *